US010352671B1

(12) United States Patent
Freeman et al.

(10) Patent No.: US 10,352,671 B1
(45) Date of Patent: Jul. 16, 2019

(54) AUTOMATED PRIMER MANUFACTURING MACHINE AND PROCESS

(71) Applicant: The United States of America as Represented by the Secretary of the Army, Washington, DC (US)

(72) Inventors: Cathleen Freeman, Pompton Lakes, NJ (US); Andrew Zimmer, Wharton, NJ (US); Mark Motyka, Cedar Grove, NJ (US); Christopher Csernica, Port Murray, NJ (US); Anthony Hawthorne, Vernon, NJ (US); Charles Sturdivant, Franklin, TN (US); Tom Massey, Franklin, TN (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 15/941,142

(22) Filed: Mar. 30, 2018

Related U.S. Application Data

(60) Provisional application No. 62/482,817, filed on Apr. 7, 2017.

(51) Int. Cl.
*F42B 33/02* (2006.01)
*F42B 3/195* (2006.01)
*F42C 19/08* (2006.01)

(52) U.S. Cl.
CPC ..... *F42B 33/02* (2013.01); *F42B 3/195* (2013.01); *F42C 19/08* (2013.01)

(58) Field of Classification Search
CPC ..... F42B 33/00; F42B 33/001; F42B 33/002; F42B 33/04; F42B 33/0207; F42B 33/0214; F42B 33/0241; F42B 33/02; F42B 33/025; F42C 19/10; F42C 19/0823
USPC ..... 86/19.8
See application file for complete search history.

(56) References Cited

U.S. PATENT DOCUMENTS 232,238 A * 9/1880 Burns ..... F42B 33/001 86/43
232,907 A * 10/1880 Salisbury ..... F42B 33/001 86/12
237,276 A * 2/1881 Hobbs ..... F42B 33/001 86/12
301,003 A * 6/1884 Poole ..... F42B 33/025 86/29

(Continued)

FOREIGN PATENT DOCUMENTS

CN 104848749 8/2015
EP 0334725 9/1989

(Continued)

*Primary Examiner* — Derrick R Morgan
(74) *Attorney, Agent, or Firm* — Lisa H. Wang

(57) ABSTRACT

A fully automated modular primer processing unit is provided that is controllable, tailorable and increases the safety of operators over current methods. The modular primer process unit is comprised of a plurality of stations. Exemplary stations include: 1) primer cup insertion station, 2) an energetic filling station, 3) a drying station, 4) a consolidation unit, and 5) an anvil insertion station. Additional stations such as a tray feed station, a primer sealing station and a tray stacking station may also be configured with the modular primer processing unit.

12 Claims, 5 Drawing Sheets

(56) References Cited

U.S. PATENT DOCUMENTS 365,919 A * 7/1887 Harrison ..... F42B 33/025 86/29
659,630 A * 10/1900 Simmons ..... F42B 33/001 100/237
755,920 A * 3/1904 Olin ..... F42B 33/002 86/18
906,214 A * 12/1908 Freeman ..... G07F 11/16 193/21
1,119,162 A * 12/1914 Hough ..... F42B 33/025 86/20.14
1,144,216 A * 6/1915 Lavan ..... F42B 33/025 86/20.14
1,245,528 A * 11/1917 Talley ..... F42B 33/0207 86/20.12
1,346,064 A * 7/1920 Remmen ..... F42B 33/0214 86/20.12
1,600,059 A * 9/1926 Murphy ..... F42C 19/10 102/470
1,664,480 A * 4/1928 Murphy ..... B21D 53/00 29/34 R
2,005,260 A * 6/1935 Huyett ..... B30B 15/067 425/389
2,350,556 A * 6/1944 Hotchkiss ..... F42B 33/025 72/55
2,387,661 A * 10/1945 Holcomb ..... F42B 33/002 141/237
2,395,898 A * 3/1946 Mohr ..... F42B 33/025 141/73
2,662,818 A 12/1953 Schuricht
2,718,342 A * 9/1955 Anderson ..... F42B 33/002 53/246
2,794,359 A * 6/1957 Lyman, III ..... F42B 33/04 86/36
2,818,964 A * 1/1958 Picard ..... F42B 33/002 112/108
3,014,400 A * 12/1961 Smith ..... F42B 33/02 86/33
3,019,688 A * 2/1962 Hunt ..... F42B 33/002 100/99
3,159,512 A 12/1964 Von Herz
3,244,082 A * 4/1966 Lemelson ..... B65B 5/02 156/500
3,581,619 A * 6/1971 Makay ..... B30B 11/10 86/10
3,911,821 A 10/1975 Finot
4,267,774 A * 5/1981 Hall, Jr. ..... F42B 4/04 102/201
4,429,610 A * 2/1984 Mantel ..... F42B 33/004 86/23
4,522,665 A 6/1985 Yates, Jr.
5,054,363 A * 10/1991 Scharch ..... B65B 5/08 198/399
5,353,707 A 10/1994 Duguet
5,435,223 A * 7/1995 Blodgett ..... F42B 33/04 86/38
5,437,393 A * 8/1995 Blicher ..... A47F 1/03 141/369
6,283,680 B1 * 9/2001 Vidal ..... B65G 53/32 222/207
6,505,558 B1 * 1/2003 La Mura ..... F41A 19/68 102/217
6,877,433 B1 * 4/2005 Stevenson ..... A62C 99/0054 102/334
7,552,668 B1 * 6/2009 Gonzalez ..... F42B 33/00 86/45
7,670,446 B2 3/2010 Puszynski
7,694,618 B1 * 4/2010 Lee ..... F42B 33/001 86/32
7,806,034 B1 * 10/2010 Lee ..... F42B 33/001 86/37
8,257,523 B1 * 9/2012 Puszynski ..... C06B 31/38 149/108.2
9,689,651 B1 * 6/2017 Lee ..... F42B 33/002
2007/0131707 A1 * 6/2007 Poole ..... B65B 1/12 222/14
2007/0186511 A1 * 8/2007 Hultberg ..... B65B 9/045 53/433
2010/0024933 A1 * 2/2010 Stec, III ..... C06B 21/0025 149/92
2012/0227558 A1 * 9/2012 Goetsch ..... B24C 1/045 83/167
2013/0139675 A1 * 6/2013 Baxter ..... F42B 33/001 86/31
2013/0206913 A1 * 8/2013 Stevenson ..... A01C 1/042 244/137.1
2014/0260925 A1 * 9/2014 Beach ..... F42B 33/001 86/28
2014/0318353 A1 * 10/2014 Crandall ..... F42B 33/06 86/49
2015/0198429 A1 * 7/2015 Mirza ..... F42B 33/04 86/37
2015/0246769 A1 * 9/2015 Pearlson ..... B65G 65/40 414/21
2016/0025471 A1 * 1/2016 Nixon ..... B22C 9/06 86/18
2016/0313103 A1 * 10/2016 Bergmann ..... F42B 33/001
2017/0121039 A1 * 5/2017 Ciesiun ..... B33Y 10/00
2017/0314901 A1 * 11/2017 Howarth ..... F42B 33/00

FOREIGN PATENT DOCUMENTS

EP 0580486 1/1994
WO WO2006083379 8/2006

* cited by examiner

AUTOMATED PRIMER MANUFACTURING MACHINE AND PROCESS

RIGHTS OF THE GOVERNMENT

The inventions described herein may be manufactured and used by or for the United States Government for government purposes without payment of any royalties.

FIELD OF INVENTION

The present invention relates generally to processes for manufacturing primers and more specifically automating the process for manufacturing primers to increase consistency, safety and accuracy over current methods.

RELATED APPLICATIONS

This application claims the benefit of priority to provisional application No. 62/482,817 filed Apr. 7, 2017, the contents of which is incorporated by reference herein in its entirety.

BACKGROUND OF THE INVENTION

Primers are designed to be used in ammunition, fuze systems, or initiating systems for the purpose of converting mechanical, electrical, optical or thermal impetus into chemical energy output. Such primers are typically composed of a cup holding an energetic formulation, foiling or sealing device, and an anvil/closure disc.

The process of primer fabrication involves mixing raw chemicals into an energetic formulation, dispensing the energetic formulation into conventional primer hardware, drying the energetic formulation to remove processing solvents and moisture, inserting a foil which both prevents dusting of material during processing and contains material in cup during handling and transport, consolidation of mix, anvil insertion, and sealing, if necessary, to protect the primer from moisture absorption and to contain the material during handling and transport. Current primer manufacturing processes are labor intensive, lack consistency, inefficient and presents safety risks to operators during assembly. The process requires preparation of the energetic primer formulation which is conducted by adding individual constituents to a planetary mixer and utilizing shear mixing at controlled speeds for a set duration of time to achieve the desired consistency. Solvents are utilized during the mixing process to ensure consistency of the mixture and increase safety during handling. Maintenance of minimum solvent concentrations greatly reduces the materials' initiation sensitivity to impetuses such as friction, impact or electro-static discharge (ESD). These solvents are typically used in an open mixer which is exposed to ambient air where evaporation is hard to control and solvent percentages are difficult to maintain or analyze. Maintaining the moisture content for safety purposes also affect the consistency of the primers as the current formulation is loaded volumetrically. The energetic mixture is then spread by hand to disseminate into fill quantity by volume of the primer hardware. Transfer of the energetic material into the primer hardware is by an imprecise method which does not verify transfer. Foil and lacquer is placed over the energetic mixture which is consolidated and the anvil inserted over the assembly. After the components are assembled, the primer is dried for an extended period of time before it is operable. Each step in the process is completed either manually or by hand operation using semi-automated equipment.

The current process outline above fails to provide consistent testing and verification for quality control purposes during each step of the process. Quality control is subject to operator training who is required to visualize hundreds if not thousands of parts that are smaller than the diameter of a dime. The human operators are exposed to safety risks inherent with operation of energetic materials. Such risk may be minimized by controlling the quantity of energetic formulation in the process area and manually maintaining moisture levels of the energetic formulation and processing equipment. However, determination of the quantity of moisture to add is typically based on visual inspection and not a quantifiable metric.

Given the drawbacks noted above, a need exists for more efficient, consistent and safer primer manufacturing methods. The invention disclosed herein provide methods to automate the primer manufacturing process that is not only more controllable, tailorable and repeatable but also increases the safety of operators over current methods by enabling stand-off distances and reducing potential operator error.

SUMMARY OF INVENTION

It is an object of the invention to provide a fully automated modular primer processing unit that is controllable, tailorable and increases the safety of operators over current methods. The modular primer process unit is comprised of 1) a primer cup insertion station, 2) an energetic filling station, 3) a drying station, 4) a consolidation station, and 5) an anvil insertion station, wherein the primers are processed in trays that move sequentially through each station.

In one aspect of the invention, the primer cup insertion station is comprised of a cup escapement, vibratory cup feeder, cup separator, and multi-axis gantry robot. The cup escapment is comprised of cup feed, a bottom cup separator and a top cup separator.

In another aspect of the invention, the energetic filling station is in communication with the cup insertion station, wherein the energetic filling station fills the primer cups with energetic primer composition that is sustained as a homogenous mixture during the dispensing process. The energetic filling station comprises a multi-axis gantry robot, and valves for dispensing the energetic primer composition into each primer cup. The valve for dispensing the homogenous energetic mixture, maintained in its homogenous state, includes positive displacement pneumatic valves such as pneumatic actuated valves, auger and digitally controlled valves.

In yet another aspect of the invention, a drying station is provided that is in communication with the energetic filling station, said drying station is comprised of a vacuum chamber, a tray stacking and destacking apparatus. The vacuum chamber is comprised of a dome, servo-motor actuators that can move the dome up and down over a stack of trays, and a vacuum pump.

In yet another aspect of the invention, a consolidation station is provided that is in communication with the drying station, wheren the consolidation station comprises consolidation press and a multi-axis gantry robot. The consolidation press further comprising a foil disc application apparatus a plurality of press heads and feedback sensor to sense the force of consolidation.

In yet another aspect of the invention, an anvil insertion station in communication with the consolidation station, wherein the anvil inesrtion station comprises an anvil escapement, an anvil invertor, an anvil pick and place system, and an anvil press. The anvil escapment is comprised of an anvil feed, a bottom anvil separator and a top anvil separator. The anvil press is further comprised of press heads and a press plate to act upon the anvils.

In yet another aspect of the invention, each of the stations identified above comprises sensors selected from the group consisting of three-dimensional scanning lasers, two-dimensional scanning laser, pressure sensor, moisture sensor, photoelectric sensor, proximity laser sensor, and imaging sensor.

In yet another aspect of the invention, the process trays utilized in the modular primer processing unit are transferred through the plurality of stations by the tray transfer mechanism using servo-motor actuators mounted below the processing trays.

In a second object of the invention, the modular primer processing unit provided above further comprises a sealant station having a sealant, dispensing valve for dispensing the sealant, and assembly for curing said sealant. The sealant station further comprises three dimensional laser scanner to collect data for creating a three dimensional profile of the sealed cups.

In a third object of the invention, the modular primer processing unit provided in the first object of the invention further comprises a tray feed station.

In a fourth object of the invention, the modular primer processing unit provided in the first object of the invention further comprises a tray stacking station wherein the tray stacking station comprises tray indexing apparatus and tray stacking apparatus.

BRIEF DESCRIPTION OF THE DRAWINGS

Further features and advantages of the present invention may be understood from the drawings.

DETAILED DESCRIPTION

Figure 1:
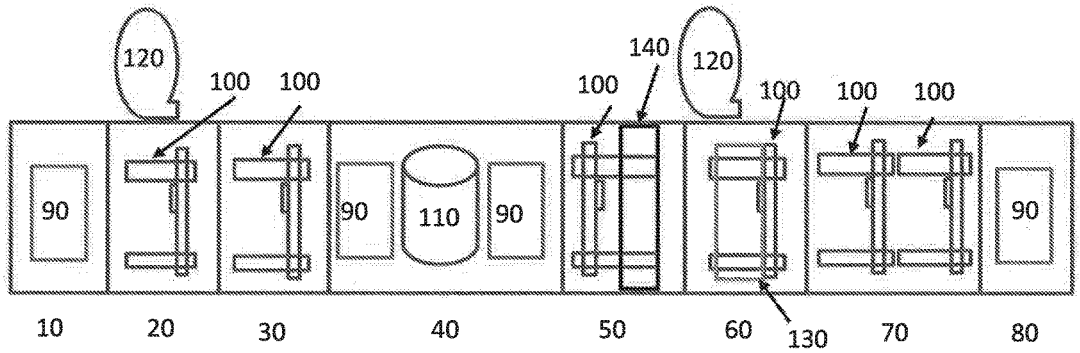
FIG. 1 is an illustration of a modular processing units comprising multiple processing stations.

Disclosed herein is a modular processing unit for automated manufacture of primers. FIG. 1 illustrates a representative modular processing unit comprised of a plurality of stations labeled as follows: tray feed station 10, primer cup insertion station 20, energetic fill station 30, drying station 40, consolidation station 50, anvil insertion station 60, sealant and rejection station 70 and stacking station 80. The primer manufacturing process is initiated at the tray feed station 10 where process trays 90 holding primer assembly components that are assembled at each station transits through the processing unit until it exits the stacking station 80 as a fully assembled primer.

Tray Configuration

Processing trays 90 (represented as a square in Station 10) may be specifically configured for use in the modular processing unit. Such process trays 90 may be configured with partial through holes laid out in a regularly spaced grid. The size and dimensions of the through holes may be adapted to hold the specific primer size being assembled. The size and shape of the process trays and spacing of the primer hardware can vary based on the scale and desired throughput. For illustration purposes a process tray having 20×20 thru hole grid (400 total spaces for holding primer) may be prepared.

Each process tray may be fixed with four (4) hardened pins, one at each corner, to be utilized as spacing between the process trays during stacking and location registration throughout the process. At each processing station, two of the pins are held in place and positively located for position. Once positive location is confirmed, this registers in the process control system that the process tray is in place and further processing can continue. A laser sensor can be utilized to verify process tray placement, use of proximity and visual sensors could also be integrated for this purpose based on the scale and layout of the tray and process.

Transfer and Tracking

The process trays 90 are advanced through each step of the processing unit using servo motor driven lever assemblies mounted below the process trays. The process trays may be transferred on top of rails that run the length of the process. To avoid static buildup which can be dangerous when working with energetic materials, a material with a low coefficient of friction should be utilized. Any material selected should also ensure smooth transfer of the process trays. An exemplary material such as ultra-high-molecular weight (UHMW) polyethylene may be used.

Each station has individual mechanisms integrated into the process control automation. Levers engage grooves along the process tray edges and servo motors control movement of the lever and push the process tray to the next station at a controlled rate of distance over time. High precision servo motors may be used to enable tailoring the rate of process tray transfer based on processing rate requirements. In addition, the servo motors enable the stoppage of individual process trays by the process control system if necessary for safety purposes. The combination of a controlled slide mechanism over a track may be utilized in lieu of a traditional conveyor belt to minimize potential pinch points of residual energetic material and to facilitate easier clean up.

The process trays may be tracked by fitting each tray with a unique tracking identification, readable by the process control system. This enables clear correlation between each individual process tray and the corresponding logged process control data, even if the process tray was removed from the process during manufacturer. Should a process tray be removed, and a new process tray come through to be processed, the process control system will be able to clearly identify what step the process tray has undergone, and provide feedback to the operator if the process tray was improperly replaced. Tracking systems such as radio frequency identification (RFID) tags, unique barcodes with alternate scanner types, unique physical marking or image in conjunction with an image sensor may also be utilized, with RFID tags being preferred.

In Process Control

The process is operated utilizing an automated process control system. The process control system consists of a Human Machine Interface (HMI), gantry robots and associated controllers, servo motors and associated controllers, quality control sensors and associated controllers, any additional digitally control devices in the process such as vacuum pumps, pneumatic valves, and RFID tag reads, and all associated required network and communication cables to connect all associated devices. The HMI contains a graphic display of the process, as well as displays of data feedback from the process robotic, servo and sensor equipment. In conjunction with the process control system, there are cameras mounted throughout the system that run through a digital video recorder (DVR) to a display monitor, providing the operator live-feed visual of all of the processing steps and energetic materials.

Operation: The HMI contains programmed software which dictates the method of operation. There are a wide variety of programming methods and types of software that can be utilized to automate this process. Generally speaking, the program may control the controllers of the process digital components to take action, and for a specified duration. The controllers will then communicate those commands to their associated hardware. The controllers will provide feedback to the program on the result that was achieved. For instance, sensors may provide feedback from multi-axis gantry robots and servo-driven actuators as to the distance the process trays traveled and force exerted on the primer composition. The program will then analyze the result in comparison to the command that was given and to the allowable variation within that command, and determine if the operation was successfully performed or not. If not, the error will be indicated on the HMI interface. The operator will then have the capability to select individual or multiple pieces of equipment to pause. The process is also equipped with the capability to automatically stop the entire process, or specific process steps, if specific errors occur. This feature is typically used for safety measures. In addition, the process program has the capability to track errors throughout the process, and use that information to stop further processing on that specific tray location. For example, if a cup is dropped during placement and a tray location is missing a cup, the sensor in that station will register that there is no cup during analysis. As that process tray continues through the process, no further processing steps will be completed on that location. Therefore the process tray partial thru hole holding the primer cup will not be filled with energetic materials, or inserted with an anvil, etc. This feedback control enables continued operation with a small quantity of defects, and also prevents potentially unsafe processing situations. In another example, if a cup was filled with an excessive amount of primer composition, the system will not then try to insert an anvil at the location and potentially cause an overflow of energetic material. For additional safety precautions, the HMI and visual surveillance monitor may also be mounted in a separate room from the process machinery, enabling remote operation. The distance from the process control and process machinery was planned according to in-production quantities, and can be adjusted by utilizing longer cabling.

Station 10—Tray Feed Station

The tray feed station 10 is equipped with a tray indexing mechanism, a stack of process trays to feed the process, and a tray transfer mechanism.

A stack of process trays 90 required for a set time interval is manually placed at the beginning of the process. An indexing mechanism holds all but the bottom tray of the stack, while the tray transfer mechanism comprising servo motors pushes the process trays from the bottom of a stack into the cup insertion station 20. The indexing mechanism then lowers the stack, disengages, then raises back to the second from the bottom tray and slightly elevates the tray to prepare the next tray to be pushed. The process control system dictates initiation of the servo motor mechanisms moving the process trays throughout the system.

Station 20—Cup Insertion Station

Figure 2:
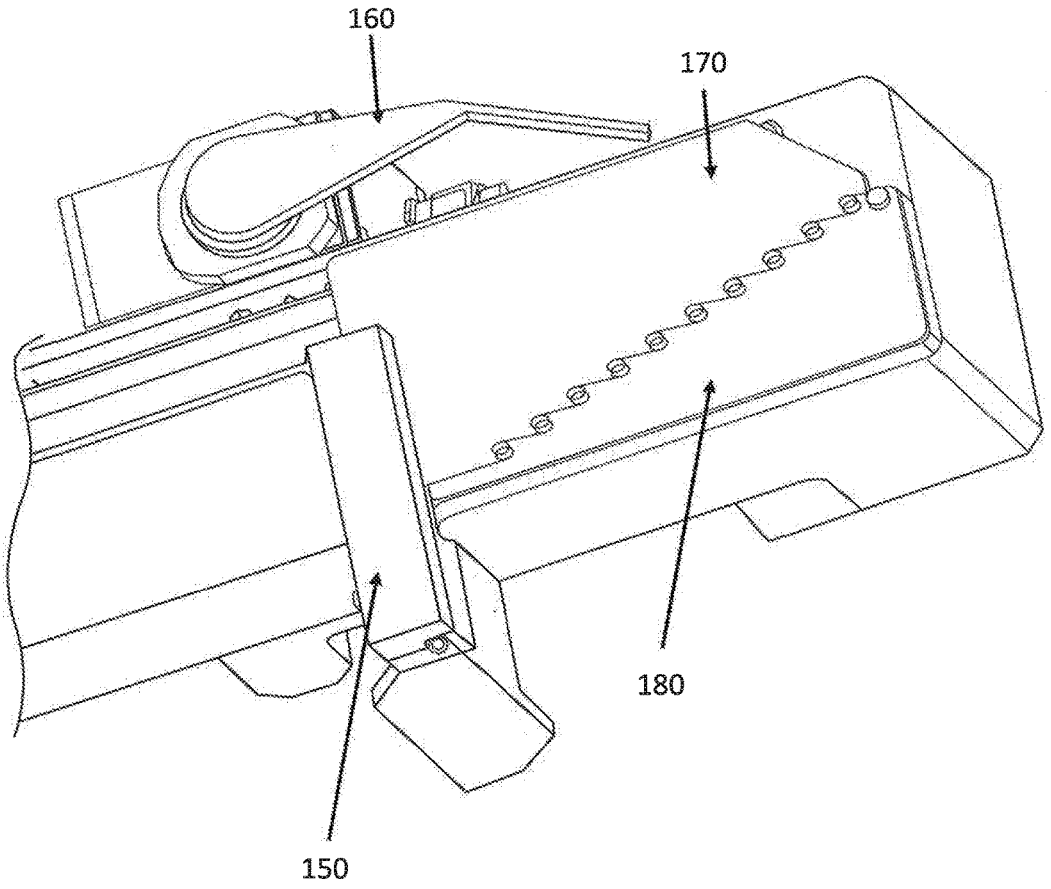
FIG. 2 is an illustration of primer cup escapement.

The cup insertion station 20 is equipped with a tray transfer mechanism, a vibratory cup feeder 120, a cup escapement, a multi-axis gantry robot 100, a pick and place mechanism, and a laser scanner. The station can process one tray at a time although multiple trays may be processed simultaneously by increasing the number of gantry robots and tray transfer mechanisms. The cup escapement, illustrated in FIG. 2, is comprised of a cup feed 150, cup feed hold bar 160, bottom cup separator 170, and top cup separator 180 as well as actuators, laser sensor and hardware customized to fit the required cup hardware.

The cup insertion station 20 ensures that the primer cups are properly oriented and loaded into the processing trays for filling. The process is initiated by having the primer cups flow from a vibratory cup feeder 120. The feeder 120 may be tailored to the size and weight of the cups required for the end item to feed them at the required rate. Cups that are improperly oriented are returned to the basin of the vibratory feeder while cups that are properly oriented are allowed to flow along the feeder track to the cup escapement illustrated in FIG. 2. The cup escapement comprises the cup feed 150 and cup feed hold bar 160 which enables the cups to be feed at a steady rate into the bottom cup separator 170 and a top cup separator 180. The bottom cup separator 170 spaces the cups into the alignment and spacing required for placement into the tray. It does so at a specific rate controlled by a servo motor, and with a piece of hardware that is formed to mirror the contour of the hardware it is moving. This enables movement of the cups into the proper spacing without flipping or turning them. The bottom cup separator 170 moves the cups to a stop at the top cup separator 180, which then holds the cups in position from the opposite side to await pickup.

As the cups enter the cup separators, sensors verify that a complete set of cups is present. The cups are also inspected to verify quality and fit using three-dimensional or two-dimensional image sensors. The cup separators ensures the steady transfer of cups into appropriate spacing, and positioning of the cups to enable gantry robotic pickup. One actuator drives the mechanism to separate the cups and is operated on a slight angle to ensure cups are not flipped or improperly oriented while being spaced. The second actuator then adjusts the position of the separated cups so that they are parallel to the tray and can be picked up for placement.

After each set of cups are properly spaced and oriented it may be further inspected to ensure that the outer diameter and overall height of the cups meet final item quality and fit requirements (e.g. surface finish, absence of cup dents or chips, and overall cup roundness) for loading into the process tray.

The inspection can be accomplished using inspection sensor apparatus having lasers mounted to a multi-axis robot head. The multi-axis gantry robots are servo driven machines, controlled by a digital input. The axes are separately controlled, and are at right angles to each other. Two axis gantry robots enables movement in the x and y directions, three-axis enable movement in the x, y and z directions. Use of the multi-axis gantry robots enables movement of the processing action for a specific step, while keeping the process tray of primers in a fixed position.

Upon completion of inspection, a pick and place mechanism is used to load the cups into the process tray. The pick and place mechanism is mounted to the same multi-axis gantry robot head as the inspection laser. It utilizes vacuum suction to pick the cups up from the cup separator mechanism. If any cups did not pass inspection requirements, the entire set of cups is transferred to a collection receptacle and the next set of cups is inspected. After the initial set of cups are inserted, the loading process is repeated until all open positions on the process tray are filled. After all cups are approved and loaded, the laser scanner used to inspect the cups will then scan every location on the process tray to confirm that each cup is loaded into position. After cup insertion, the process trays are pushed by the servo motor driven mechanism to the filling station 30. Ifa thru hole is missing a cup, the process control system will log the omitted cup from that position and it will be excluded from further processing.

Station 30—Fill Station

The fill station 30 consists of a tray transfer mechanism, a multi-axis gantry robot 100, a dispensing valve assembly, and sensors.

The fill station 30 utilizes positive displacement dispensing valves to fill each cup individually with a precise amount of energetic primer composition. The quantity and capacity of dispensing valves can be tailored to the scale and rate of production. The valve(s) are mounted on a multi-axis gantry robot head for dispensing the required amount of energetic primer composition. The amount of composition dispensed may be regulated by a volume adjustment associated with the valve. The quantity or volume of energetic material may be preset prior to dispensing. A singular valve or multiple valves may be used, depending on the requirements of the system. In an exemplary system, a set of four valves in line was employed to enable simultaneous filling of four cups. The fill quantity is typically volumetrically controlled, however weight controlled dispensing methods may also be used. The energetic formulation can be fed to the valves in individual reservoirs for each valve, or from a singular feed vessel. The process control system may verify accurate location and actuate the valves individually. Valve actuation for this system may involve the process control system sending a digital signal to the valve controllers to operate, then the valve controller pressurizing the required port to enable flow of material. Selection of the valves use for dispensing the primer composition depends on the formulation, chemical, rheological and safety requirements. Exemplary valves suitable for use include pneumatic actuated valves, auger or digitally controlled valves with pneumatic actuated valves being preferred.

Sensors such as laser displacement sensor, imaging or photoelectric sensors may be mounted on or near the multi-axis gantry robot used for filing the cups to scan every position to confirm that each cup is filled to the proper level. After filling and verification, the tray transfer mechanism transfers the process trays to the drying station 40.

Valve dispensing of a water-based slurry energetic formulation may be used instead of the common dough ball method. Acoustic mixing of the slurry energetic formulation may be used to ensure a homogenous mixture and sufficiently suspends the homogenous slurry mix to enable reliable valve dispensing and sufficient wetting for safety purposes. Use of an acoustic mixer may also provide a digital readout of the acceleration and intensity achieved during mixing. This provides a previously unavailable means of verifying mix consistency by comparison to a standard. The acoustic mixing vessel may be incorporated directly into the energetic material feed line, or transferred to a suitable alternative.

Station 40—Drying Station

The drying station 40 consists of a tray stacking and de-stacking mechanism, a stack transfer system, a tray transfer system, a vacuum chamber assembly, a vacuum pump, moisture sensors, and a desiccant air dryer. The vacuum chamber assembly consists of a drying dome 110 and two servo-motor driven actuators employed to move the dome up and down.

The process trays entering the drying station 40 are stacked using a servo driven indexing mechanism as is used for the tray feed and stacking stations. A servo motor driven mechanism engages a process tray and lifts it to a sufficient height for the next tray to move underneath it. After the next tray has been processed and moves beneath it, the indexing mechanism lowers the tray until the hardened pins of the second tray engage the recess below the first tray. The mechanism then retracts from underneath the first tray, moves underneath the second tray, and continues the process until a desired quantity of trays is reached. The indexing mechanism integrates an actuator with a fabricated component capable of securely holding the stack of trays and lifting their combined weight. A guiding structure is used to ensure the plates do not move outside a confined area. The quantity of process trays required to be stacked will be dictated by the process rate and drying requirements. Alterations to the quantity of tracks stacked during processing can be made after the process is set up, with the limiting factor being the capacity of the drying dome 110. Once the required height of trays is reached to accommodate a set drying cycle, the stack is transferred to the drying area using servo driven controls to ensure that the trays are stable while moving. One method to keep the trays stable is to mount servo-motor arms on the side of the trays to pull the trays forward during transfer. This is a change in configuration from what is utilized for other stations where the servo-motor driven mechanisms are situated underneath the trays rather than the sides. Placing the servo-motor arms on the side of the trays enable a solid table surface for the vacuum dome to seal. The arms connected to the servo-driven mechanisms engage the stack of trays push them forward at a controlled rate of speed. The drying dome 110 is lowered down over the process tray stack. Vacuum is pulled for a set interval of time to complete drying. If needed, low moisture air can be fed into the system to facilitate the drying process. Moisture percentage in the chamber can be monitored over time using moisture sensors to verify completion of the dried primer stack. Once complete, the drying dome 110 is lifted from the dried primer stack. The same side-mounted actuator used to transfer the process trays into the dryer area then moves the stack out of the vacuum drying area. A second indexing mechanism then engages the process tray pile from the second to the bottom tray and lifts and enables the servo mechanism used for a singular tray used throughout the process to advance one tray at a time to the consolidation station 50. Integrated sensors monitor the moisture content of the air being removed from the system. Once a set value is reached, which has been determined by calibration to the item in production, this value will relayed to the process control system, indicating that the drying process is complete.

Station 50—Consolidation Station

The consolidation station 50 consists of a tray transfer mechanism, a consolidation press 140, and a multi-axis gantry robot 100. The consolidation press 140 consists of high-precision servo-driven actuators with integrated Linear Variable Differential Transformers (LVDTs) and load cells, a suspended foil ribbon, and a custom tool and die set for cutting the foil ribbon.

Figure 3:
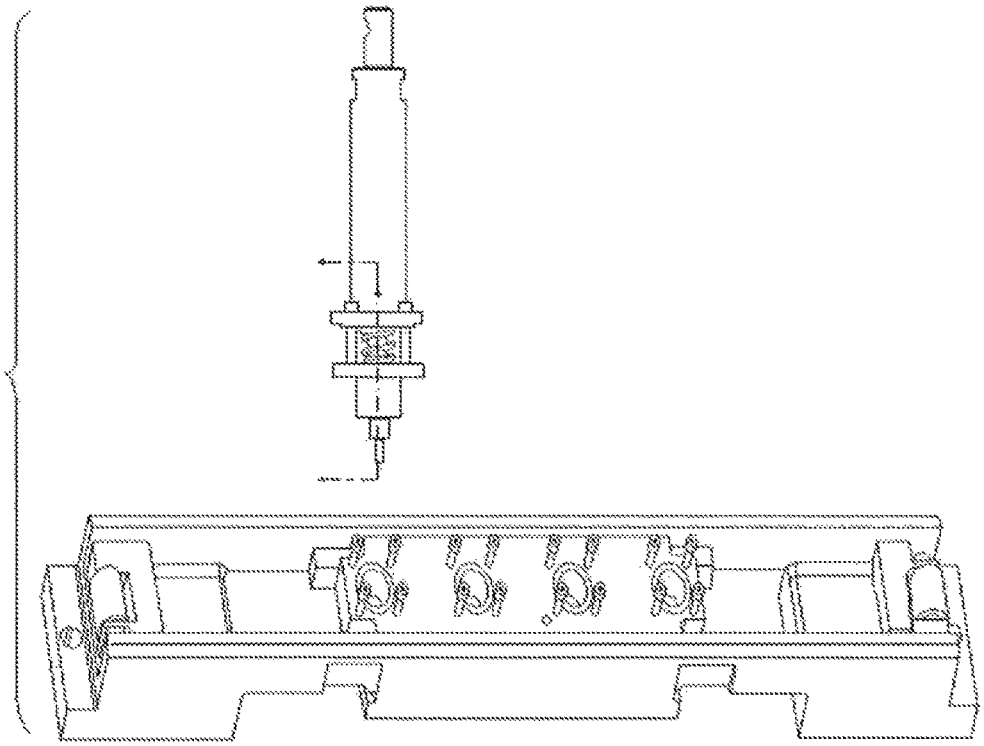
FIG. 3 is an illustration of consolidated press heads.

Upon completion of the drying process, a process tray is transferred by a tray transfer mechanism to the consolidation station 140 for foil disc insertion and energetic formulation consolidation. A multi-axis gantry robot arm engages two of the hardened pins on the tray and move it precisely inside a press frame having independently operated press heads, as illustrated in FIG. 3. By way of illustration, eight press heads arranged in two rows of four heads each may be used. The first row of four press heads is used for simultaneous consolidation and foil disc application. Each press head consist of a consolidation pin mounted onto precision servo motor, which enables precision cutting of the foil through a tool and die set. After the foil disc is cut, the pin then pushes the foil disc into each cup and consolidates the energetic formulation to the required depth, using the required force and at the designated rate. The second row of four press heads is used for contoured consolidation, repeating the same consolidation operation while shaping the energetic formulation bed into the required form for performance. Integration of LVDTs and load cells can be used to measure force during compression and consolidation depth. The LVDTs and load cells can then relay those measurements to the process control system to verify quality. After the process control system receives feedback from the consolidation heads that all operations are complete, the multi-axis gantry robot will push the process tray out of this station, and the tray transfer mechanism will push the process tray to the anvil insertion station 60.

Station 60—Anvil Insertion Station

Figure 4:
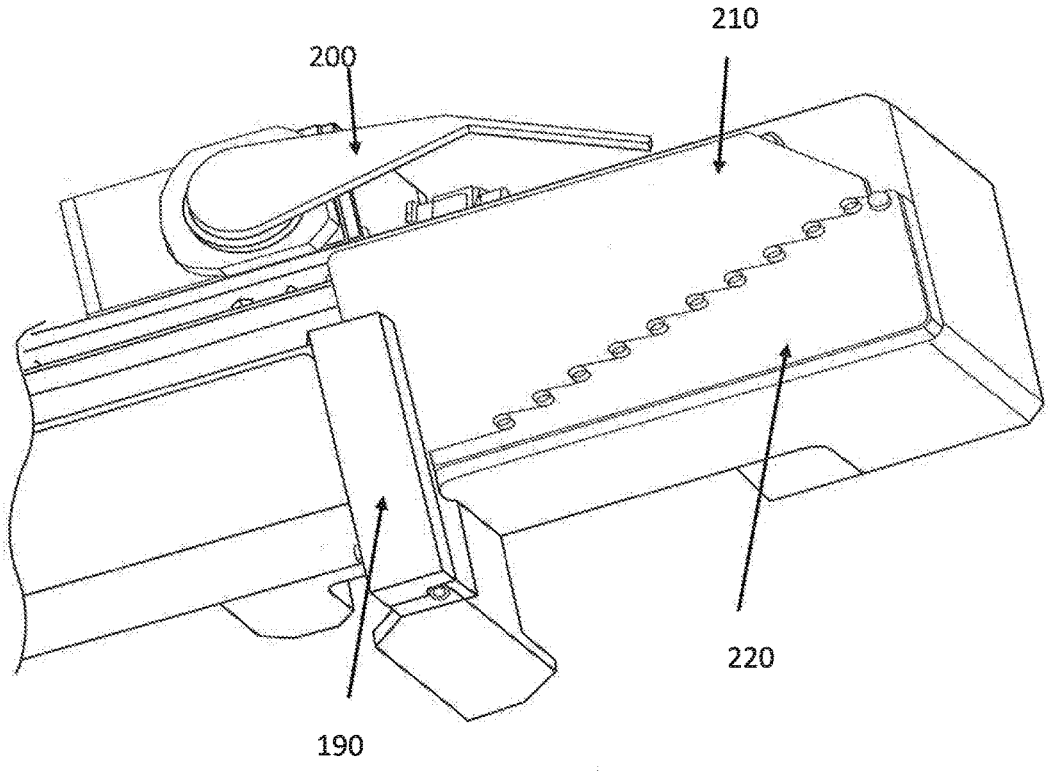
FIG. 4 is an illustration of an anvil escapement.
Figure 5:
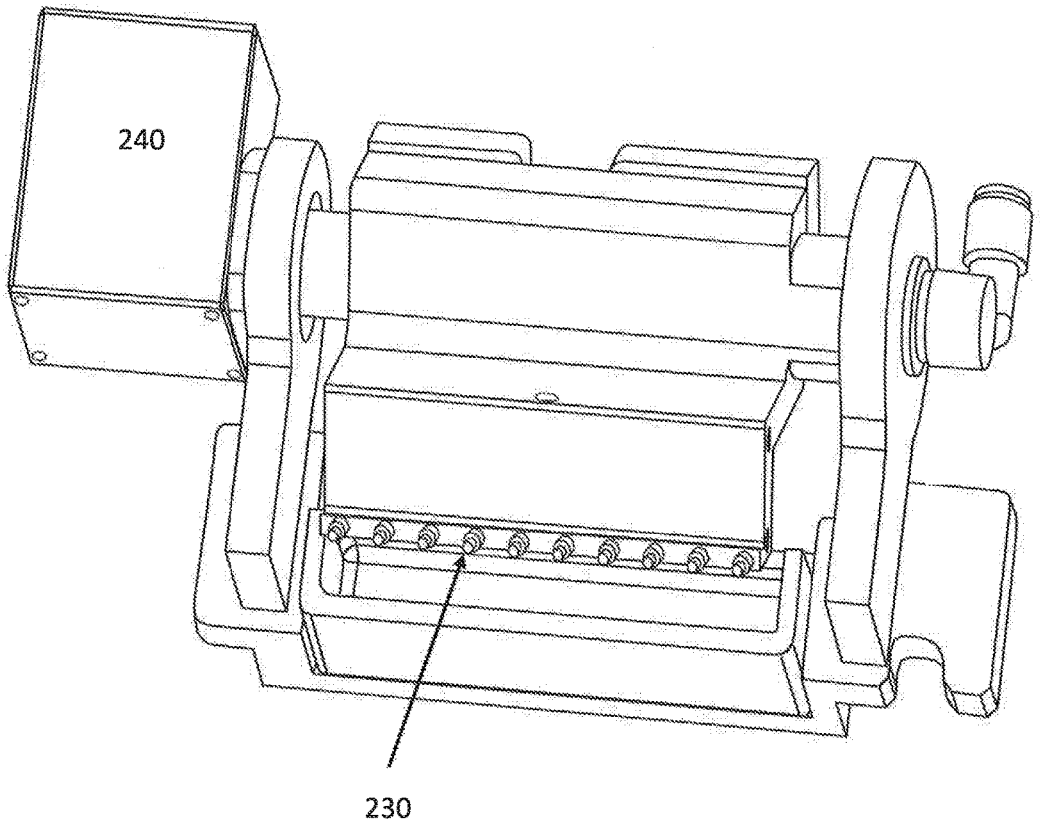
FIG. 5 is an illustration of an anvil alignment.

The anvil insertion station 60 consists of a tray transfer mechanism, an anvil vibratory feeder 120, an anvil escapement, an anvil inverter (FIG. 5), a multi-axis gantry robot 100 mounted with an anvil pickup head on a slider mechanism, and an anvil insertion press 130. The anvil insertion press 130 consist of a set of four servo-motor driven actuators acting on a singular plate to apply the force specified to insert a set of anvils. The anvil escapement (FIG. 4) is designed like the primer cup escapement having an anvil feed 190, a feed holder bar 200, a bottom anvil separator 210 and a top anvil separator 220. The bottom and top separators may been to be customized so that it is configured to accept the specific dimensions of the anvil and primer cups being used.

A vibratory cup feeder 120 may be used to move anvils into the correct positon and orientation for placement into the primer cups. Anvils that are incorrectly oriented are returned to the basin of the feeder, while those in proper orientation are moved to the anvil escapement illustrated in FIG. 4. The anvil escapement utilizes an anvil feed 190 which moves the anvils into the anvil separator. The anvil separators are comprised of a servo-motor driven mechanism mounted with a bottom anvil separator 210 and top anvil separator 220 to separate the anvils in the spacing required for insertion into the tray. A second servo-driven mechanism then aligns the anvil escapement into the correct position for inversion. The anvil inverter (FIG. 5) having a plurality of vacuum heads, uses an additional servo-driven mechanism to flip the anvils into the correct orientation for insertion. Vacuum heads 230 driven by motor 240 picks up and align anvils from the anvil escapement and flips the anvils over for the anvil pickup head to place the anvils into the primer. To verify the dimensions and orientation of the anvils prior to insertions, a laser scanner, imaging sensor or equivalent scanner capable of verifying point to point measurements can be used. The scanner is mounted to a multi-axis gantry robot head that will also be used to pick up and place the anvils into the primer cups. The scanner may create a profile of the top edges or any discernable portion of the anvil that can provide correct dimension and positioning data. If an anvil is determined to be non-compliant that particular anvil or the anvils in that grouping may picked up and place in a collection receptacle.

If the anvils meet inspection requirements, the anvil pickup head mounted to a multi-axis gantry robot uses individually controlled vacuum suction heads to pick up the anvils and situate them above the primer cups on the process tray. An anvil insertion press controlled by servo motors providing consistent load to a press plate may provide the force required to insert the anvils by pushing onto the anvil pickup head. The anvil pickup head is a component of the sliding mechanism mounted to the multi-axis gantry head. This mechanism holds the primers in place until acted on by the press plate. Once acted upon, the sliding mechanism enables the force required for anvil insertion to act on the anvil pickup head, without exerting any force on the multi-axis robot head. Upon removal of force, the sliding mechanism may return to its original position. After the anvils are approved and loaded, inspection scanner also mounted to the anvil insertion head of the multi-axis robot scans every location in the process tray using a three dimensional laser scanner. The inspection is used to confirm that each anvil is in position and at the proper depth, and any additional configuration requirements as necessary, are met. If any anvil is not seated correctly, that location in the process tray is noted in the control system to avoid future processing. If a sealant step is not needed, then the primer cups are ready for final inspection and moved to the stacking station 80. If sealant is necessary, then the process tray transfer mechanism pushes the tray out of this station to the sealing station or to the rejection station 70.

Station 70—Sealant & Rejection Station

The sealant and rejection station 70 consist of an optional sealant station, and a final rejection station. The optional sealant station includes a multi-axis gantry robot 100 mounted with a positive displacement dispensing mechanism such as a pneumatic or servo actuated dispensing valves, a curing mechanism for ultraviolet or thermal curing if necessary, and a sensor to verify quality. A laser, photoelectric, optical or imaging sensor could be used. For the sealant dispensing mechanism, multiple heads may be used to process multiple primers simultaneously. An auger or similar type valve can also be used which has the capability to dispense a weight or volume controlled amount of sealant on each primer.

The rejection station consists of a multi-axis gantry robot mounted with a vacuum pickup head and a collection receptacle. It may also consist of a final inspection scanner to verify quality. The scanner can be laser, imaging or equivalent to verify point to point measurements and any other required final quality inspections.

Depending on the primer type, a sealant material may be used to seal the primer composition from environmental effects such as moisture absorption. Positive dispensing valves, such as pneumatic or servo driven, positive displacement or auger, mounted on a multi-axis gantry robot, may be used to place a precisely controlled amount of sealant at a specified location for each primer. If required, the sealant may be cured using thermal or ultraviolet output mounted on the multi-axis robot head. After all cups have sealant applied and cured if necessary, a scanner may be used to scan every location on the process tray to verify all program requirements are met. Upon completion the process tray transfer mechanism will push the tray to the rejection station. Any primers that are found to be non-compliant will be evacuated using a vacuum fitting mounted on the multi-axis gantry robot head. The multi-axis gantry robot head will move to the position dictated by the process control system of a primer that did not meet all inspections. The robot head will then lower to pick the primer up out of the process tray, and move it to a collection receptacle, where vacuum will be released and the primer placed. After all operations are complete, the tray transfer mechanism pushes the process tray into stacking station 80.

Station 80—Stacking Station

The stacking station 80 consists of a tray stacking mechanism.

The process trays entering the stacking station are stacked using a servo driven indexing mechanism as is used for the drying station. A servo motor driven mechanism engages a process tray and lifts it to a sufficient height for the next tray to move underneath it. After the next tray has been processed and moves beneath it, the indexing mechanism lowers the process tray until the hardened pins of the second tray engage the recess below the first tray. The mechanism then retracts from underneath the first tray, moves underneath the second tray, and continues the process. The indexing mechanism integrates an actuator with a fabricated component capable of securely holding the stack of trays and lifting their combined weight. The indexing mechanism stacks the trays to the desired height for removal from the room and further processing or packaging.

In one embodiment, the proposed manufacturing line is about 5.5 feet wide by eighteen feet long assembled inside a room or enclosed area. The line may process 11.5 inch square process trays. Each process tray has 400 assembly locations on a 20 by 20 pattern at ½ inch spacing. The trays sit on top of conductive, low friction rails that run the length of the process. The process tray is advanced through the process utilizing a tray transfer mechanism consisting of servo motors and associated hardware, mounted below the process trays, with the exception of the drying area as discussed previously above. Each station has individual mechanisms integrated into the process control automation. Levers engage grooves along the process tray edges, and servo motors control movement of the lever and push the tray to the stations depicted in FIG. 1. Each process tray is fixed with 4 hardened pins, one at each corner, to be utilized as spacing between the trays during stacking and location registration throughout the process. Each process tray is fitting with a readable barcode or tag, such as an RFID, to aid in tracking of the process through each station. The entire line is automated and remotely operated.

The foregoing description of the preferred embodiment of the present invention has been presented for the purpose of illustration and description. It is not intended to be exhaustive or to limit the invention to the precise form disclosed. Many modifications and variations are possible in light of the above teachings. It is intended that the scope of the present invention not be limited by this detailed description but by the claims and any equivalents.

The invention claimed is:

1. A modular primer processing unit comprising:

a. primer cup insertion station comprising a vibratory cup feeder, cup escapement, a first multi-axis gantry robot; wherein said cup escapement comprises a bottom cup separator and a top cup separator, and servo-motor driven actuators;

b. energetic filling station in communication with the primer cup insertion station, wherein said energetic filling station comprises a second multi-axis gantry robot and positive displacement pneumatic valves for dispensing homogenous energetic, mixture maintained in its homogenous state, into each primer cup;

c. drying station in communication with the energetic filling station, wherein said drying station comprises a vacuum chamber assembly, tray stacking and tray destacking apparatus;

d. consolidation station in communication with the drying station wherein the consolidation station comprises consolidation press and a third multi-axis gantry robot;

e. anvil insertion station in communication with the consolidation station, wherein said anvil insertion station comprises an anvil vibratory feeder and an anvil escapement, wherein said anvil escapement comprises a bottom anvil separator and a top anvil separator, and servo-motor driven actuators; and wherein the modular primer processing unit is a fully automated manufacturing line.

2. The modular primer processing unit of claim 1, wherein each station comprises sensors selected from the group consisting of three-dimensional scanning lasers, two-dimensional scanning laser, pressure sensor, moisture sensor, photoelectric sensor, proximity sensor, and imaging sensor.

3. The modular primer processing unit of claim 1, wherein the consolidation station comprises a foil disc application apparatus, a plurality of press heads and feedback sensor to sense the force of consolidation.

4. The modular primer processing unit of claim 1, wherein the anvil insertion station further comprises a three dimensional scanner to create virtual images of the anvil profiles located in said station.

5. The modular primer processing unit of claim 1, wherein the sealant station comprises a sealant assembly wherein said assembly is comprised of a sealant, dispensing valve, and assembly for curing said sealant.

6. The modular primer processing unit of claim 1, further comprising a tray feed station.

7. The modular primer processing unit of claim 1, further comprising a tray stacking station.

8. The modular primer processing unit of claim 7, wherein the stacking station comprises tray indexing apparatus and tray stacking apparatus.

9. The modular primer processing unit of claim 1, wherein the trays are transferred through the plurality of stations using servo-motors mounted below the process trays.

10. The modular primer processing unit of claim 1, wherein the positive displacement pneumatic valves is comprised of pneumatic actuated valves, auger and digitally controlled valves.

11. The modular primer processing unit of claim 1, further comprising a plurality of processing trays wherein the processing trays comprises grooves process tray edges and fixed pins.

12. A process for automated primer manufacturing comprising feeding a plurality of primer cups into the modular primer processing unit of claim 1 to produce finished energetic primers.

* * * * *